US009243833B2

(12) United States Patent
Yun et al.

(10) Patent No.: US 9,243,833 B2
(45) Date of Patent: Jan. 26, 2016

(54) ICE MAKING SYSTEM FOR A REFRIGERATOR APPLIANCE AND A METHOD FOR DETERMINING AN ICE LEVEL WITHIN AN ICE BUCKET

(71) Applicant: General Electric Company, Schenectady, NY (US)

(72) Inventors: Seokki Yun, Seungnam-si (KR); Geon Ho Kim, Seungnam-si (KR); Dong Soo Shin, Seoul (KR); Kang Sun Lee, Seoul (KR)

(73) Assignee: General Electric Company, Schenectady, NY (US)

( * ) Notice: Subject to any disclaimer, the term of this patent is extended or adjusted under 35 U.S.C. 154(b) by 168 days.

(21) Appl. No.: 14/071,935

(22) Filed: Nov. 5, 2013

(65) Prior Publication Data

US 2015/0121942 A1 May 7, 2015

(51) Int. Cl.
*F25C 5/18* (2006.01)

(52) U.S. Cl.
CPC ..... *F25C 5/187* (2013.01)

(58) Field of Classification Search
CPC ..... F25C 5/187; F25C 5/18; F25C 2700/00
USPC ..... 62/137, 344, 66, 157
See application file for complete search history.

(56) References Cited

U.S. PATENT DOCUMENTS

| | | | | |
|---|---|---|---|---|
| 6,286,324 | B1 | 9/2001 | Pastryk et al. | |
| 7,779,641 | B2 * | 8/2010 | Lee et al. | 62/137 |
| 8,196,419 | B2 | 6/2012 | Woo | |
| 8,424,323 | B2 * | 4/2013 | Austin et al. | 62/137 |
| 2005/0138951 | A1 * | 6/2005 | Hooker | 62/389 |
| 2007/0063981 | A1 * | 3/2007 | Galyean et al. | 345/173 |
| 2009/0013708 | A1 * | 1/2009 | Truitt | 62/264 |
| 2009/0211292 | A1 * | 8/2009 | Smith et al. | 62/344 |
| 2009/0272130 | A1 * | 11/2009 | Kim et al. | 62/66 |
| 2009/0293510 | A1 * | 12/2009 | Kim et al. | 62/73 |
| 2010/0046793 | A1 * | 2/2010 | Ashrafzadeh et al. | 382/100 |
| 2010/0139299 | A1 * | 6/2010 | Lee et al. | 62/137 |
| 2011/0100039 | A1 * | 5/2011 | Kim et al. | 62/139 |
| 2011/0138842 | A1 * | 6/2011 | Chase et al. | 62/344 |
| 2011/0214442 | A1 * | 9/2011 | Visin et al. | 62/137 |

FOREIGN PATENT DOCUMENTS

KR 20090109418 10/2009

* cited by examiner

*Primary Examiner* — Mohammad M Ali
(74) *Attorney, Agent, or Firm* — Dority & Manning, P.A.

(57) ABSTRACT

An ice making system for a refrigerator appliance is provided. The ice making system includes an ice maker, an ice bucket and an ice cube level sensing assembly. The ice cube level sensing assembly includes an infrared light emitter and an infrared light receiver. The infrared light emitter directs infrared light into a storage volume of the ice bucket, and the infrared light receiver receives infrared light from the infrared light emitter reflected by ice cubes within the storage volume of the ice bucket.

20 Claims, 6 Drawing Sheets

ICE MAKING SYSTEM FOR A REFRIGERATOR APPLIANCE AND A METHOD FOR DETERMINING AN ICE LEVEL WITHIN AN ICE BUCKET

FIELD OF THE INVENTION

The present subject matter relates generally to ice buckets for refrigerator appliances and systems for determining or measuring an ice level within such ice buckets.

BACKGROUND OF THE INVENTION

Certain refrigerator appliances include an icemaker. The icemaker receives liquid water and freezes such liquid water to generate ice cubes. The ice cubes are generally directed to an ice bucket where the ice cubes are stored prior to consumption. To maintain a sufficient supply of ice cubes in the ice bucket, the icemaker can initiate an ice making cycle to replenish a diminished ice cube supply. For example, certain icemakers include a feeler arm that determines when an ice cube level in the ice bucket drops below a certain height. The icemaker initiates the ice making cycle when the ice cube level drops below the height.

Feeler arms are generally positioned at a top portion of the ice bucket such that the feeler arm can rotate over the ice bucket and impact ice cubes when the ice bucket is full. Feeler arms can operate reliably to determine the ice level within the ice bucket. However, feeler arms can occupy a significant volume above the ice bucket and limit an ice storage capacity of the ice bucket.

Accordingly, an ice making system with features for determining an ice level within an ice bucket of the ice making system while occupying a small volume of space would be useful. In addition, an ice making system with features for determining an ice level within an ice bucket of the ice making system while not significantly limiting a size of the ice bucket would be useful.

BRIEF DESCRIPTION OF THE INVENTION

The present subject matter provides an ice making system for a refrigerator appliance. The ice making system includes an ice maker, an ice bucket and an ice cube level sensing assembly. The ice cube level sensing assembly includes an infrared light emitter and an infrared light receiver. The infrared light emitter directs infrared light into a storage volume of the ice bucket, and the infrared light receiver receives infrared light from the infrared light emitter reflected by ice cubes within the storage volume of the ice bucket. Additional aspects and advantages of the invention will be set forth in part in the following description, or may be apparent from the description, or may be learned through practice of the invention.

In a first exemplary embodiment, an ice making system for a refrigerator appliance is provided. The ice making system includes an ice maker configured for generating ice cubes. An ice bucket defines a storage volume. The storage volume of the ice bucket is positioned for receiving the ice cubes from the ice maker. An ice cube level sensing assembly includes an infrared light emitter and an infrared light receiver. The infrared light emitter is positioned adjacent the ice bucket. The infrared light emitter is positioned for directing infrared light into the storage volume of the ice bucket. The infrared light receiver is positioned adjacent the infrared light emitter. The infrared light receiver is positioned such that the infrared light receiver receives infrared light from the infrared light emitter reflected by the ice cubes in the storage volume of the ice bucket.

In a second exemplary embodiment, an ice making system for a refrigerator appliance is provided. The ice making system includes an ice maker configured for generating ice cubes and an ice bucket. The ice bucket defines a storage volume. The storage volume of the ice bucket is positioned for receiving the ice cubes from the ice maker. An ice cube level sensing assembly includes an infrared light emitter and an infrared light receiver. The infrared light emitter is positioned proximate the ice bucket. The infrared light emitter is oriented such that the infrared light emitter is configured for directing infrared light into the storage volume of the ice bucket. The infrared light receiver is positioned proximate the infrared light emitter. The infrared light receiver is oriented such that the infrared light receiver is configured for receiving infrared light from the infrared light emitter reflected by the ice cubes in the storage volume of the ice bucket.

In a third exemplary embodiment, a method for determining an ice level within an ice bucket of a refrigerator appliance is provided. The method includes directing a ray of infrared light into a storage volume of the ice bucket and receiving a ray of reflected infrared light from the storage volume of the ice bucket if ice within the storage volume is positioned above a predetermined height in the storage volume.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
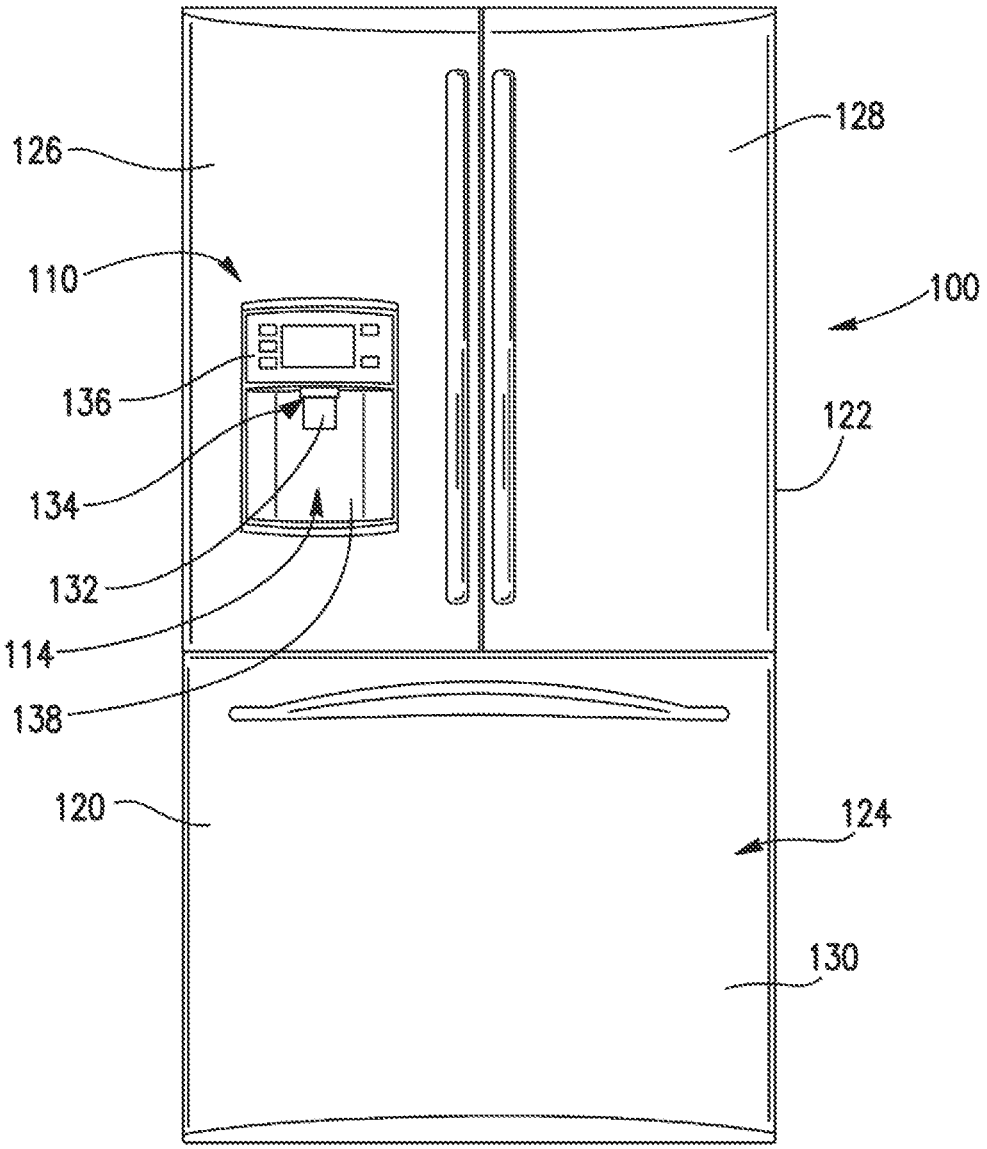
FIG. 1 provides a front, elevation view of a refrigerator appliance according to an exemplary embodiment of the present subject matter FIG. 2 provides a front, elevation view of the exemplary refrigerator appliance of FIG. 1 with doors of the exemplary refrigerator appliance shown in an open position to reveal fresh food chamber of the exemplary refrigerator appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
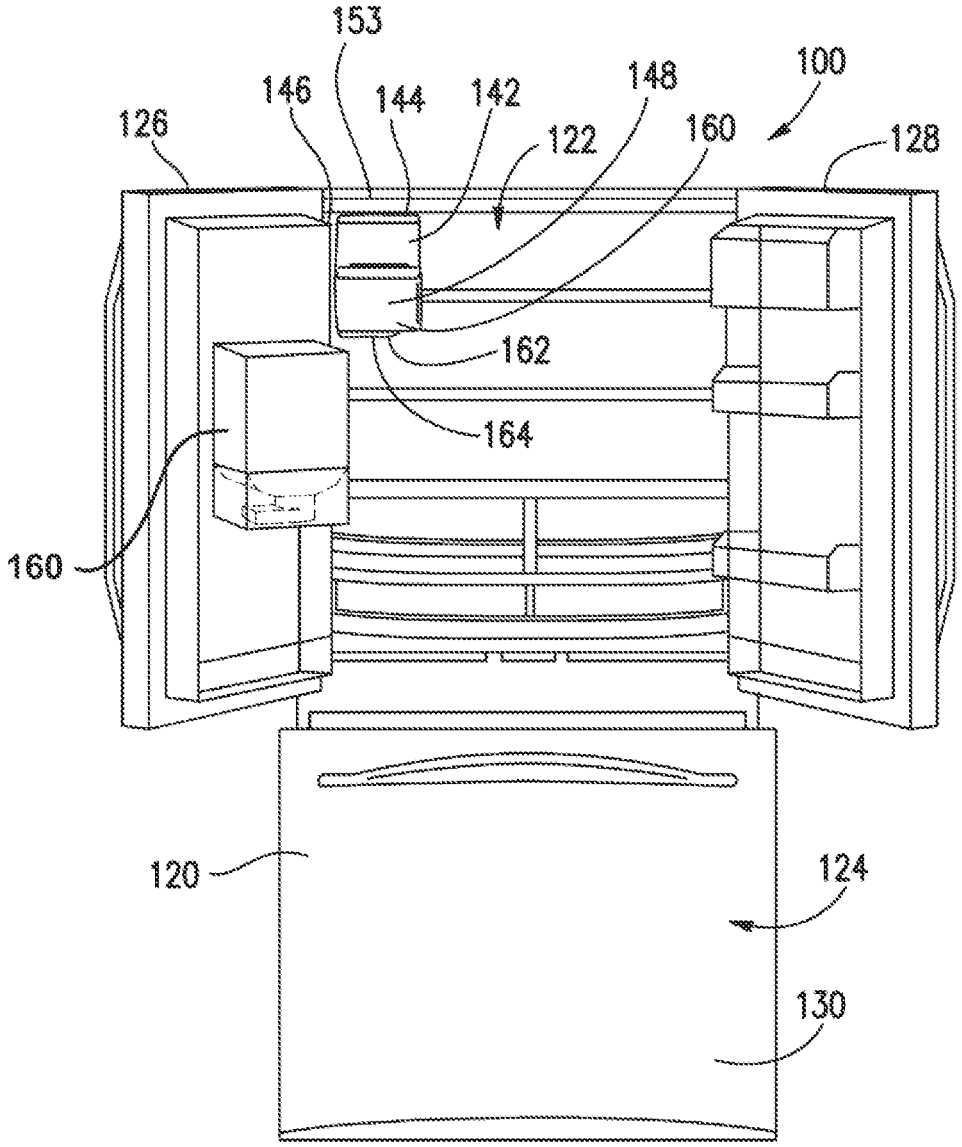

FIG. 1 provides a front, elevation view of a refrigerator appliance 100 according to an exemplary embodiment of the present subject matter. FIG. 2 provides a front, elevation view of refrigerator appliance 100 with refrigerator doors 126 and 128 of refrigerator appliance 100 shown in an open position to reveal a fresh food chamber 122 of refrigerator appliance 100. Refrigerator appliance 100 defines a vertical direction V and a lateral direction L. The vertical direction V and lateral direction L are mutually perpendicular and form an orthogonal direction system. Refrigerator appliance 100 extends between an upper portion 101 and a lower portion 102 along the vertical direction V. Refrigerator appliance 100 also extends between a first side portion 105 and a second side portion 106 along the lateral direction L.

Refrigerator appliance 100 includes a cabinet or housing 120 that defines chilled chambers for receipt of food items for storage. In particular, refrigerator appliance 100 defines fresh food chamber 122 at upper portion 101 of refrigerator appliance 100 and a freezer chamber 124 arranged below fresh food chamber 122 on the vertical direction V, e.g., at lower portion 102 of refrigerator appliance 100. As such, refrigerator appliance 100 is generally referred to as a bottom mount refrigerator appliance. However, using the teachings disclosed herein, one of skill in the art will understand that the present subject matter may be used with other types of refrigerator appliances (e.g., side-by-side style or top mount style) or a freezer appliance as well. Consequently, the description set forth herein is for illustrative purposes only and is not intended to limit the present subject matter to any particular chilled chamber arrangement or configuration.

Refrigerator doors 126 and 128 are rotatably hinged to an edge of housing 120 for accessing fresh food compartment 122. In particular, refrigerator doors 126 and 128 are rotatably mounted to housing 120 at an opening 121 that permits access to fresh food chamber 122. A freezer door 130 is arranged below refrigerator doors 126 and 128 for accessing freezer chamber 124. Freezer door 130 is coupled to a freezer drawer (not shown) slidably mounted within freezer chamber 124.

Refrigerator appliance 100 also includes a dispensing assembly 110 for dispensing liquid water and/or ice. Dispensing assembly 110 includes a dispenser 114 positioned on or mounted to an exterior portion of refrigerator appliance 100, e.g., on refrigerator door 126. Dispenser 114 includes a discharging outlet 134 for accessing ice and liquid water. An actuating mechanism 132, shown as a paddle, is mounted below discharging outlet 134 for operating dispenser 114. In alternative exemplary embodiments, any suitable actuating mechanism may be used to operate dispenser 114. For example, dispenser 114 can include a sensor (such as an ultrasonic sensor) or a button rather than the paddle. A user interface panel 136 is provided for controlling the mode of operation. For example, user interface panel 136 can include user inputs, such as a water dispensing button (not labeled) and an ice-dispensing button (not labeled), for selecting a desired mode of operation such as crushed or non-crushed ice.

Discharging outlet 134 and actuating mechanism 132 are an external part of dispenser 114 and are mounted in a dispenser recess 138. Dispenser recess 138 is positioned at a predetermined elevation convenient for a user to access ice or water and enabling the user to access ice without the need to bend-over and without the need to access freezer chamber 124. In the exemplary embodiment, dispenser recess 138 is positioned at a level that approximates the chest level of a user.

Turning now to FIG. 2, certain components of dispensing assembly 110 are illustrated. Dispensing assembly 110 includes an insulated housing 142 mounted within fresh food chamber 122. Due to the insulation which encloses insulated housing 142, the temperature within insulated housing 142 can be maintained at levels different from the ambient temperature in the surrounding fresh food chamber 122.

Insulated housing 142 is constructed and arranged to operate at a temperature that facilitates producing and storing ice. More particularly, insulated housing 142 contains an ice maker for creating ice and feeding the same to an ice bucket 160 that is mounted on refrigerator door 126. As illustrated in FIG. 2, ice bucket 160 is placed at a vertical position on refrigerator door 126 that will allow for the receipt of ice from a discharge opening 162 located along a bottom edge 164 of insulated housing 142. As refrigerator door 126 is closed or opened, ice bucket 160 is moved in and out of position under insulated housing 142. In alternative exemplary embodiments, insulated housing 142 and the ice maker located therein can be mounted at any other suitable location in refrigerator appliance 100, such as on refrigerator door 126.

FIGS. 3, 4, 5 and 6 provide schematic views of an ice making system 200 according to an exemplary embodiment of the present subject matter with various amounts of ice cubes 250 positioned within an ice bucket 210 of ice making system 200. Ice making system 200 can be used with or in any suitable refrigerator appliance. For example, ice making system 200 may be used in or with refrigerator appliance 100 (FIG. 1). As discussed in greater detail below, an ice cube level sensing assembly 230 of ice making system 200 is configured for determining or detecting a height or level of ice cubes 250 within ice bucket 210. Knowledge of the height of ice cubes 250 within ice bucket 210 can assist with proper operation of an ice maker 220 of ice making system 200.

Ice making system 200 includes an ice bucket 210 and an ice maker 220. Ice maker 220 is positioned above ice bucket 210, e.g., along the vertical direction V. Ice maker 220 is configured or arranged for generating ice cubes 250. For example, ice maker 220 can receive liquid water, and such liquid water can freeze within ice maker 220 to generate or form ice cubes 250.

Figure 3:
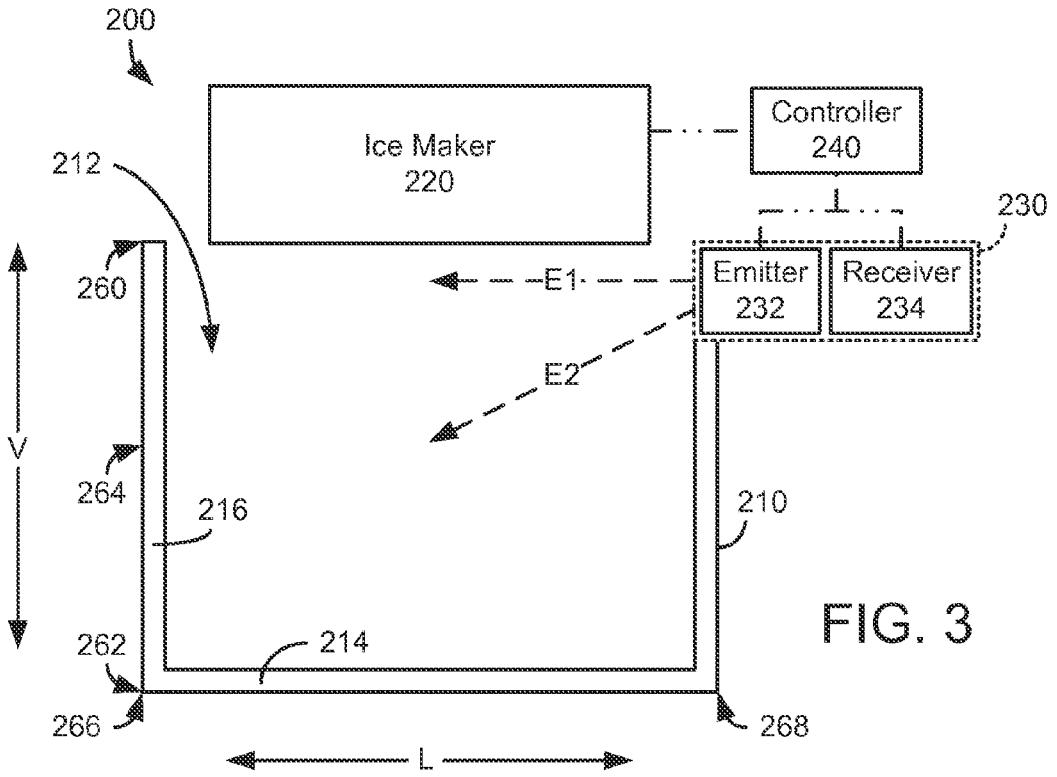
FIGS. 3, 4, 5 and 6 provide schematic views of an ice making system according to an exemplary embodiment of the present subject matter with various amounts of ice positioned within an ice bucket of the exemplary ice making system.

Ice bucket 210 defines a storage volume 212. For example, a bottom wall 214 and a sidewall 216 of ice bucket 210 can define storage volume 212 of ice bucket 210 such that ice cubes 250 are contained or supported within storage volume 212 by bottom wall 214 and sidewall 216 of ice bucket 210. Storage volume 212 of ice bucket 210 is positioned for receiving ice cubes 250 from ice maker 220. Thus, as shown in FIG. 3, storage volume 212 of ice bucket 210 is positioned, e.g., directly, below ice maker 220 along the vertical direction V such that ice cubes 250 generated by ice maker 220 drop downwardly along the vertical direction V from ice maker 220 into storage volume 212. In alternative exemplary embodiments, ice cubes 250 can be directed into storage volume 212 of ice bucket 210 using any suitable method or mechanism, such as a conduit or auger.

Storage volume 212 of ice bucket 210 extends between a top portion 260 and a bottom portion 262, e.g., along the vertical direction V. Thus, top and bottom portions 260 and 262 of storage volume 212 are spaced apart from each other, e.g., along the vertical direction V. A middle portion 264 of storage volume 212 is positioned between top and bottom portions 260 and 262 of storage volume 212, e.g., along the vertical direction V. Storage volume 212 also extends between a first side portion 266 and a second side portion 268, e.g., along the lateral direction L. Thus, first and second side portions 266 and 268 of storage volume 212 are spaced apart from each other, e.g., along the lateral direction L.

Ice cube level sensing assembly 230 is positioned at or adjacent top portion 260 of ice bucket 210. Ice cube level sensing assembly 230 is also positioned at or adjacent second side portion 268 of ice bucket 210. Ice cube level sensing assembly 230 includes at least one infrared light emitter 232 (e.g., a first infrared light emitter and a second infrared light emitter) and at least one infrared light receiver 234 (e.g., a first infrared light receiver and a second infrared light receiver). Infrared light emitter 232 can be any suitable infrared light source or emitter. For example, infrared light emitter 232 may be an infrared light emitting diode. Infrared light receiver 234 can be any suitable infrared light detector or receiver. For example, infrared light receiver 234 may be an infrared phototransistor. Infrared light emitter 232 and infrared light receiver 234 are positioned proximate or adjacent each other. Thus, infrared light emitter 232 and infrared light receiver 234 are both positioned at or adjacent top portion 260 and second side portion 268 of ice bucket 210.

Infrared light emitter 232 is positioned or oriented for directing infrared light into storage volume 212 of ice bucket 210. Thus, as may be seen in FIG. 3, infrared light emitter 232, e.g., selectively, directs rays of infrared light (shown with arrows labeled E1 and E2) into storage volume 212 of ice bin 210. In particular, infrared light emitter 232 may be positioned or oriented for directing emitted infrared light rays E1 and E2 towards first side portion 266 of ice bucket 210, e.g., from second side portion 268 of ice bucket 210. Emitted infrared light rays E1 and E2 can assist with determining or detecting the level of ice cubes 250 in storage volume 212 of ice bucket 210 as discussed in greater detail below.

Infrared light receiver 234 is positioned or oriented for receiving infrared light from storage volume 212 of ice bucket 210. Thus, as may be seen in FIG. 6, infrared light receiver 234 receives or detects rays of reflected infrared light (shown with arrows labeled R1 and R2) from storage volume 212 of ice bin 210. In particular, infrared light receiver 234 is positioned or oriented such that infrared light receiver 234 receives or detects infrared light from infrared light emitter 232 reflected by ice cubes 250 in storage volume 212 of ice bucket 210. Infrared light receiver 234 may be positioned or oriented for receiving or detecting reflected infrared light rays R1 and R2 at second side portion 268 of ice bucket 210.

As may be seen in FIG. 3, ice cube level sensing assembly 230 directs first emitted infrared light ray E1 in a first direction and second emitted infrared light ray E2 in a second, different direction. In particular, ice cube level sensing assembly 230 may direct first emitted infrared light ray E1 towards top portion 260 of storage volume 212 and second emitted infrared light ray E2 towards middle portion 266 of bottom portion 264 of storage volume 212. The first and second emitted infrared light rays E1 and E2 define an angle $\alpha$ therebetween. The angle $\alpha$ can be any suitable angle. For example, the angle $\alpha$ may be greater than about zero degrees and less than about ninety degrees or greater than about fifteen degrees and less than about seventy-five degrees. The first and second emitted infrared light rays E1 and E2 can also have any suitable frequency. For example, first emitted infrared light ray E1 may have a first frequency and second emitted infrared light ray E2 may have a second frequency. The first and second frequencies may be about equal to each other or may be substantially different from each other such that first and second reflected infrared light rays R1 and R2 are distinguishable or discernible by frequency.

Operation of the ice making system 200 can be regulated by a controller 240 (shown schematically in FIGS. 3, 4, 5 and 6) that is operatively coupled to various components of ice making system 200. Controller 240 may include a memory and one or more microprocessors, CPUs or the like, such as general or special purpose microprocessors operable to execute programming instructions or micro-control code associated with operation of ice making system 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 240 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 240 and various operational components of ice making system 200, e.g., via one or more signal lines or shared communication busses.

Figure 8:
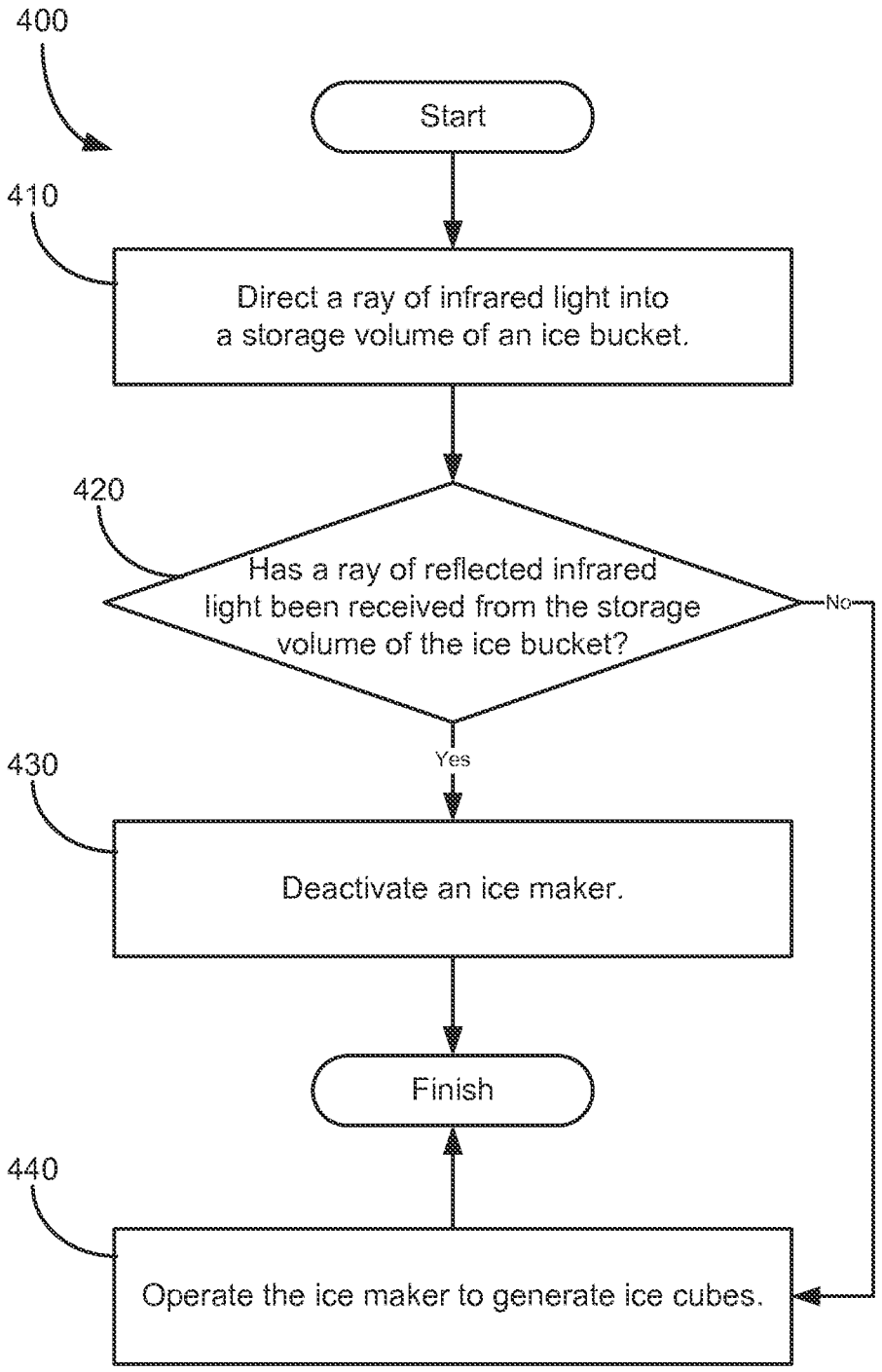
FIG. 8 illustrates a method for determining an ice level within an ice bucket of a refrigerator appliance according to an exemplary embodiment of the present subject matter.

FIG. 8 illustrates a method 400 for determining an ice level within an ice bucket of a refrigerator appliance according to an exemplary embodiment of the present subject matter. Method 400 can be used with or in any suitable refrigerator appliance or ice making system. For example, method 400 may be used in or with refrigerator appliance 100 (FIG. 1) and/or ice making system 200 (FIG. 3). In particular, controller 240 of ice making system 200 may be programmed or configured to implement method 400. Utilizing method 400, a level of ice cubes 250 within storage volume 212 of ice bucket 210 can be determined or detected accurately and/or precisely.

At step 410, a ray of infrared light is directed into storage volume 212 of ice bucket 210. For example, as may be seen in FIGS. 3 and 6, controller 240 can operate or work infrared light emitter 232 of ice cube level sensing assembly 230 in order to direct first emitted infrared light ray E1 towards top portion 260 of storage volume 212 and/or second emitted infrared light ray E2 towards middle portion 266 or bottom portion 264 of storage volume 212 at step 410.

At step 420, controller 240 determines or establishes whether a ray of reflected infrared light has been received from storage volume 212 of ice bucket 210. For example, as may be seen in FIG. 6, controller 240 can receive a signal from infrared light receiver 234 of ice cube level sensing assembly 230 if first reflected infrared light ray R1 and/or second reflected infrared light ray R1 received or detected by infrared light receiver 234 at step 420, e.g., if ice cubes 250 fill storage volume 212 above a predetermined height in storage volume 212.

Figure 5:
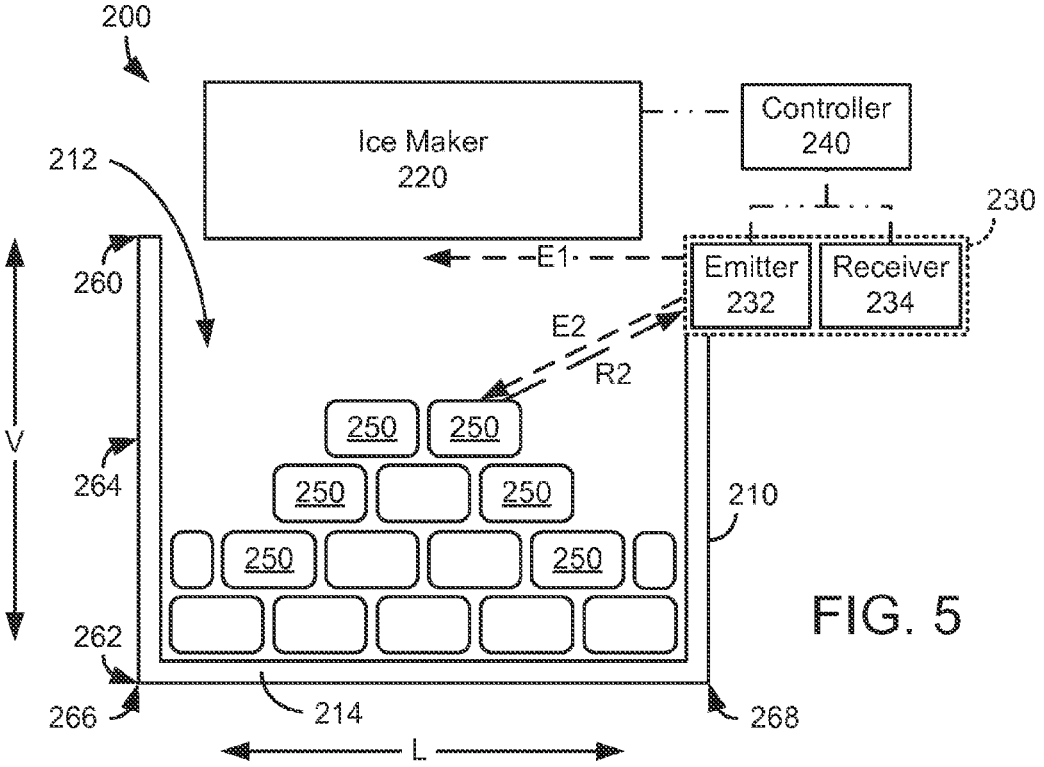
Figure 6:
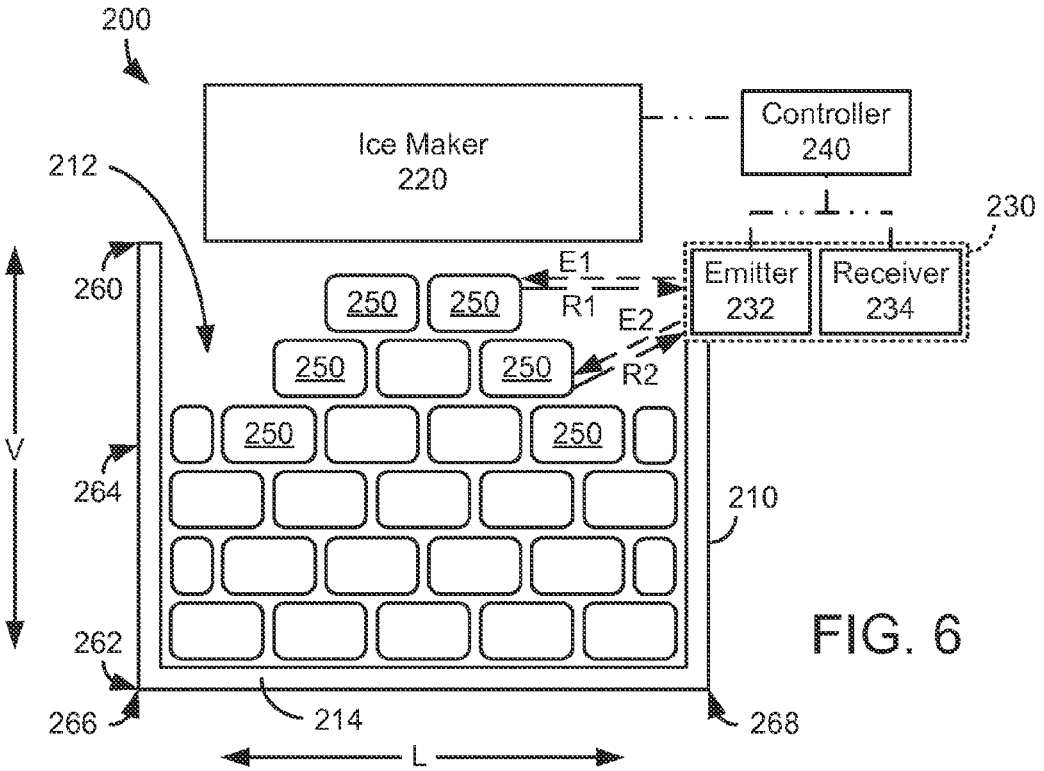

As may be seen in FIG. 3, ice bucket 210 is in an empty configuration such that storage volume 212 of ice bucket 210 has no ice cubes therein. Conversely, in FIGS. 4, 5 and 6, storage volume 212 of ice bucket 210 has ice cubes 250 positioned therein. In particular, in FIG. 4, ice bucket 210 is in a bottom fill configuration such that ice cubes 250 are positioned at or in only bottom portion 262 of storage volume 212. In FIG. 5, ice bucket 210 is in a middle fill configuration such that ice cubes 250 are positioned at or in both bottom portion 262 and middle portion 264 of storage volume 212. In FIG. 6, ice bucket 210 is in a top fill configuration such that ice cubes 250 are positioned at or in all of bottom portion 262, middle portion 264 and top portion 262 of storage volume 212.

Figure 4:
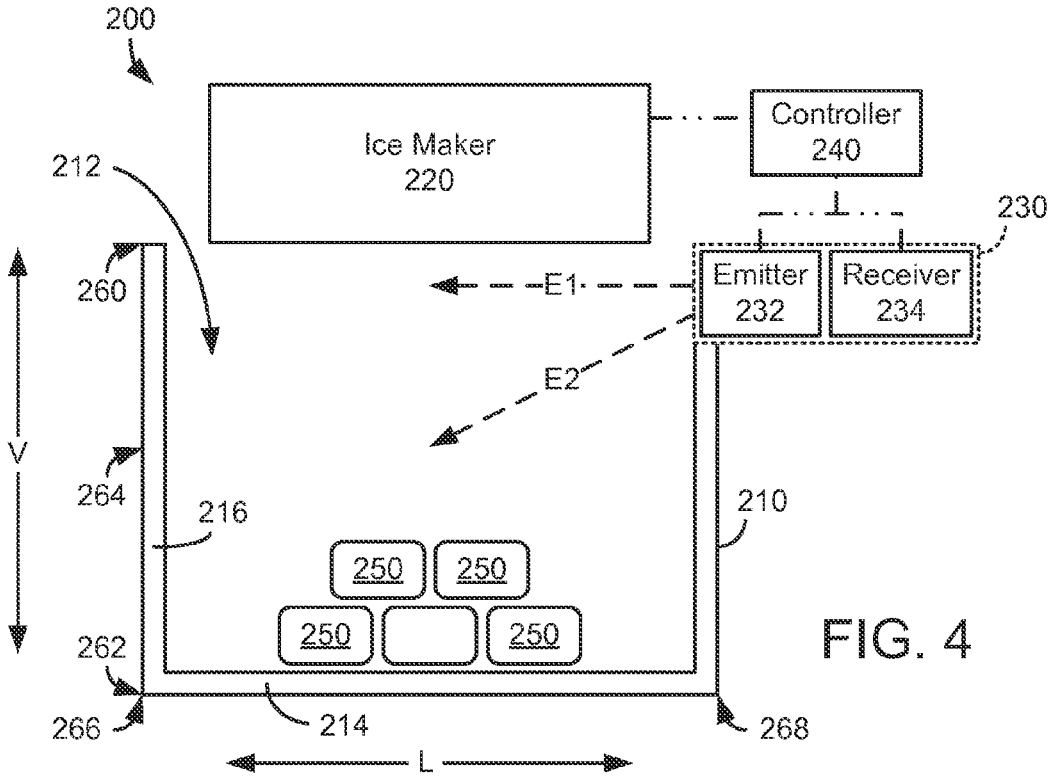

As may be seen in FIGS. 3 and 4, when ice bucket 210 is in the empty configuration or the first fill configuration, controller 240 will not receive the signal from infrared light receiver 234 at step 420, e.g., because first and second emitted infrared light rays E1 and E2 are not reflected by ice cubes within storage volume 212 back towards ice cube level sensing assembly 230. Thus, controller 240 can determine that ice bucket 210 is not full of ice cubes 250 and operate ice maker 220 to generate additional ice cubes 250 at step 440.

As may be seen in FIG. 6, when ice bucket 210 is in the top fill configuration, controller 240 will receive the signal from infrared light receiver 234 at step 420, e.g., because first and second emitted infrared light rays E1 and E2 are reflected by ice cubes 250 within storage volume 212 back towards ice cube level sensing assembly 230. Thus, controller 240 can determine that ice bucket 210 is full of ice cubes 250 and deactivate ice maker 220 at step 430 to avoid overfilling ice bucket 210.

As may be seen in FIG. 5, when ice bucket 210 is in the middle fill configuration, controller 240 will receive the signal from infrared light receiver 234, e.g., because second emitted infrared light ray E2 is reflected by ice cubes 250 within storage volume 212 back towards ice cube level sensing assembly 230. However, first emitted infrared light ray E1 is not reflected by ice cubes 250 within storage volume 212 back towards ice cube level sensing assembly 230. Thus, controller 240 can determine that ice bucket 210 is sufficiently full of ice cubes 250 and deactivate ice maker 220 to avoid overfilling ice bucket 210 at step 430, or controller 240 can operate ice maker 220 to generate additional ice cubes 250 at step 440 when ice bucket 210 is in the middle fill configuration depending upon the desired configuration or setup of ice making system 200.

Figure 7:
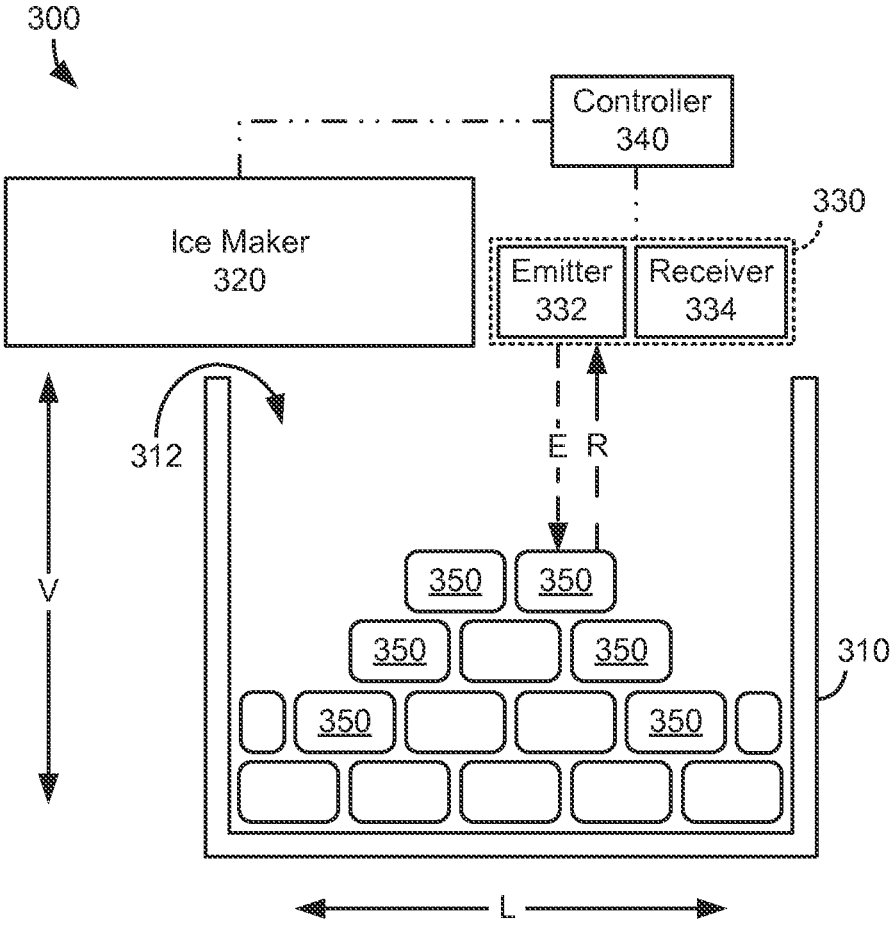
FIG. 7 provides a schematic view of an ice making system according to another exemplary embodiment of the present subject matter.

FIG. 7 provides a schematic view of an ice making system 300 according to another exemplary embodiment of the present subject matter. Ice making system 300 can be used with or in any suitable refrigerator appliance. For example, ice making system 300 may be used in or with refrigerator appliance 100 (FIG. 1). Ice making system 300 is similar to ice making system 200 (FIG. 3) and includes similar components and features and may be operated in a similar manner. Thus, method 400 may be implemented by a controller 340 of ice making system 300.

As may be seen in FIG. 7, ice making system 300 includes an ice bucket 310 that defines a storage volume 312. An ice cube level sensing assembly 330 includes at least one infrared light emitter 332 and at least one infrared light receiver 334. Ice cube level sensing assembly 330 is positioned, e.g., directly, above storage volume 312 of ice bucket 310 along the vertical direction V. Thus, infrared light emitter 332 is positioned or oriented for directing infrared light (shown with arrow E) downwardly along the vertical direction V into storage volume 312 of ice bucket 310 and towards ice cubes 350 within storage volume 312 of ice bucket 310. In particular, ice cube level sensing assembly 330 may be positioned at or adjacent (e.g., mounted to) an ice maker 320 or ice making system 300. Ice cube level sensing assembly 330 may also be mounted to ice bucket 310.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making system for a refrigerator appliance, comprising:

an ice maker configured for generating ice cubes;

an ice bucket defining a storage volume, the storage volume of the ice bucket positioned for receiving the ice cubes from the ice maker;

an ice cube level sensing assembly comprising a first infrared light emitter positioned adjacent the ice bucket, the first infrared light emitter positioned for directing infrared light haying a first frequency into the storage volume of the ice bucket;

a first infrared light receiver positioned adjacent the first infrared light emitter, the first infrared light receiver positioned such that the first infrared light receiver receives infrared light from the first infrared light emitter reflected by the ice cubes in the storage volume of the ice bucket;

a second infrared light emitter positioned adjacent the ice bucket, the second infrared light emitter positioned for directing infrared light having a second frequency into the storage volume of the ice bucket; and a second infrared light receiver positioned adjacent the second infrared light emitter, the second infrared light receiver positioned such that the second infrared light receiver receives infrared light from the second infrared light emitter that is reflected by the ice cubes the storage volume of the ice bucket, wherein the first frequency and the second frequency are different.

2. The ice making system of claim 1, wherein the ice bucket defines a lateral direction, the ice bucket extending between a first side portion and a second side portion along the lateral direction, the first infrared light emitter and the first infrared, light receiver positioned at the second side portion of the ice bucket.

3. The ice making system of claim 2, wherein the first infrared light emitter is positioned for directing infrared light towards the first side portion of the ice bucket.

4. The ice making system of claim 1, wherein the first infrared light emitter is positioned for directing infrared light in a first direction, the second infrared light emitter positioned for directing infrared light in a second direction, the first and second directions defining an angle $\alpha$ therebetween, the angle $\alpha$ being greater than about zero degrees and less than about ninety degrees.

5. The ice making system of claim 4, wherein the angle $\alpha$ is greater than about fifteen degrees and less than about seventy-five degrees.

6. The ice making system of claim 1, wherein the ice bucket defines a vertical direction, the storage volume of the ice bucket extending between a top portion and a bottom portion along the vertical direction, a middle portion of the storage volume is positioned between the top and bottom portions of the storage volume along die vertical direction, the first infrared light emitter positioned for directing infrared light towards the top portion of the storage volume, the second infrared light emitter positioned for directing infrared light towards the middle portion of the storage volume.

7. The ice making system of claim 1, wherein the first infrared light emitter comprises an infrared light emitting diode and the first infrared light receiver comprises a phototransistor.

8. The ice making system of claim 1, wherein the ice bucket defines a vertical direction, ice cube level sensing assembly positioned above the storage volume of the ice bucket along the vertical direction, the first infrared light emitter positioned for directing infrared light downwardly along the vertical direction into the storage volume of the ice bucket.

9. An ice making system for a refrigerator appliance, comprising:

an ice maker configured for generating ice cubes;

an ice bucket defining a storage volume, the storage volume of the ice bucket positioned for receiving the ice cubes from the ice maker;

an ice cube level sensing assembly comprising a first infrared light emitter positioned proximate the ice bucket, the first infrared light emitter oriented such that the first infrared light emitter is configured for directing infrared light having a first frequency into the storage volume of the ice bucket;

a first infrared light receiver positioned proximate the first infrared light emitter, the first infrared light receiver oriented such that the first infrared light receiver is configured for receiving infrared light from the first infrared light emitter reflected by the ice cubes in the storage volume of the ice bucket;

a second infrared light emitter positioned proximate the ice bucket, the second infrared light emitter oriented such that the second infrared light emitter is configured for directing infrared light having a second frequency into the storage volume of the ice bucket; and a second infrared light receiver positioned proximate the second infrared light emitter, the second infrared light receiver oriented such that the second infrared light receiver is configured for receiving infrared light from the second infrared light emitter reflected by the ice cubes in the storage volume of the ice bucket, wherein the first frequency and the second frequency are different.

10. The ice making system of claim 9, wherein the ice bucket defines a lateral direction, the ice bucket extending between a first side portion and a second side portion along the lateral direction, the first infrared light emitter and the first infrared light receiver positioned at the second side portion of the ice bucket.

11. The ice making system of claim 10, wherein the first infrared light emitter is oriented for directing infrared light towards the first side portion of the ice bucket.

12. The ice making system of claim 9, wherein the first infrared light emitter is oriented for directing infrared light in a first direction, the second infrared light emitter oriented for directing infrared light in a second direction, the first and second directions defining an angle $\alpha$ therebetween, the angle $\alpha$ being greater than about zero degrees and less than about ninety degrees.

13. The ice making system of claim 9, wherein the ice bucket defines a vertical direction, ice cube level sensing assembly positioned above the storage volume of the ice bucket along the vertical direction, the first infrared light emitter oriented for directing infrared light downwardly along the vertical direction into the storage volume of the ice bucket.

14. A method for determining an ice level within an ice bucket of a refrigerator appliance, the method comprising:

directing a first ray of infrared light having a first frequency into a storage volume of the ice bucket;

receiving a first ray of reflected infrared light from the storage volume of the ice bucket if ice within the storage volume is positioned above a first predetermined height in the storage volume;

directing a second ray of infrared light having a second frequency into a storage volume of the ice bucket;

receiving a second ray of reflected infrared light from the storage volume of the ice bucket if ice within the storage volume is positioned above a second predetermined height in the storage volume, wherein the frequency and second frequency are different such that the first and second rays of reflected infrared light are distinguishable by frequency.

15. The method of claim 14, wherein said step of directing the first ray of infrared light comprises directing the first ray of infrared light into the storage volume of the ice bucket with a first infrared light emitter of the refrigerator appliance, said step of receiving the first ray of reflected infrared light comprising receiving the first ray of reflected infrared light from the storage volume of the ice bucket at a first infrared light receiver of the refrigerator appliance.

16. The method of claim 14, wherein said step of directing the first ray of infrared light comprises directing the first ray of infrared light into the storage volume of the ice bucket with a first infrared light emitter of the refrigerator appliance positioned at a first side portion of the ice bucket, said step of receiving the first ray of reflected infrared light comprising receiving the first ray of reflected infrared light from the storage volume of the ice bucket at a first infrared light receiver of the refrigerator appliance positioned at the first side portion of the ice bucket.

17. The method of claim 14, further comprising determining whether the first ray of reflected infrared light has been received from the storage volume of the ice bucket and, if so, then deactivating an ice maker of the refrigerator appliance.

18. The method of claim 17, wherein determining whether the first ray of reflected infrared light has been received comprises sending a signal from a first infrared light receiver to a controller that the first ray of reflected infrared light has been received.

19. The method of claim 14, further comprising determining whether the first ray of reflected infrared light has been received from the storage volume of the ice bucket and, if not, then determining whether the second ray of reflected infrared light has been received from the storage volume of the ice bucket and, if so, then operating an ice maker of the refrigerator appliance to generate additional ice.

20. The method of claim 14, further comprising determining whether the first ray of reflected infrared light has been received from the storage volume of the ice bucket and, if not, then determining whether the second ray of reflected infrared light has been received from the storage volume of the ice bucket and, if so, then deactivating an ice maker of the refrigerator appliance.

* * * * *